US010030415B2

(12) United States Patent
Taylor et al.

(10) Patent No.: US 10,030,415 B2
(45) Date of Patent: Jul. 24, 2018

(54) LOCK

(71) Applicant: Lowe and Fletcher Limited, Bridgnorth (GB)

(72) Inventors: Colin Jeffrey Taylor, Walsall (GB); Matthew Peter Warrender, Birmingham (GB)

(73) Assignee: Lowe & Fletcher Limited, Bridgnorth (GB)

( * ) Notice: Subject to any disclaimer, the term of this patent is extended or adjusted under 35 U.S.C. 154(b) by 0 days.

(21) Appl. No.: 15/336,286

(22) Filed: Oct. 27, 2016

(65) Prior Publication Data

US 2017/0114567 A1 Apr. 27, 2017

(30) Foreign Application Priority Data

Oct. 27, 2015 (GB) ..... 1518974.9

(51) Int. Cl.
*E05B 37/02* (2006.01)
*E05B 37/00* (2006.01)

(52) U.S. Cl.
CPC ..... *E05B 37/0034* (2013.01); *E05B 37/0058* (2013.01); *E05B 37/02* (2013.01)

(58) Field of Classification Search
CPC .. E05B 37/0034; E05B 37/0058; E05B 37/02; E05B 19/205; E05B 37/025
USPC ..... 70/446, 21, 284, 285, 312, 327, 328, 70/DIG. 21, DIG. 22, DIG. 23, DIG. 32,
(Continued)

(56) References Cited

U.S. PATENT DOCUMENTS 3,633,388 A * 1/1972 Atkinson ..... E05B 37/02 292/169
4,048,821 A * 9/1977 Bako ..... E05B 37/025 70/25

(Continued)

FOREIGN PATENT DOCUMENTS

| | | | |
|---|---|---|---|
| EP | 2942457 | A | 11/2015 |
| JP | 2012026249 | A | 9/2012 |
| WO | 2010118805 | A1 | 10/2010 |

OTHER PUBLICATIONS

Great Britain Intellectual Property Office, Search Report re Application No. GT1518974.9, dated Apr. 11, 2016, 1 pg.

(Continued)

*Primary Examiner* — Lloyd A Gall
(74) *Attorney, Agent, or Firm* — Greenberg Traurig, LLP

(57) ABSTRACT

A lock including a body which houses a combination lock, which is releasable by the selection of a set code, the code being selectable by the movement of one or more dials, the or each dial including a first part which is manipulable by a user, wherein the lock includes a code finding device to enable the set code to be identified, the code finding device including a code finding member associated with the or each dial, the or each code finding member being engageable with a second part of the respective dial, to identify a position of the dial which corresponds with a digit of the set code, wherein the second part of each dial is moveable relative to the first part of the respective dial and relative to the respective code finding member between a disengaged position and an engaged position, and wherein the or each code finding member is fixed substantially stationary relative to the body.

9 Claims, 2 Drawing Sheets

(58) Field of Classification Search
USPC ..... 70/DIG. 44, DIG. 55, DIG. 75, 311, 70/315–320, 323–326
See application file for complete search history.

(56) References Cited

U.S. PATENT DOCUMENTS

| | | | | |
|---|---|---|---|---|
| 4,722,208 | A * | 2/1988 | Ye | E05B 37/02 70/312 |
| 5,007,262 | A * | 4/1991 | Nakai | E05B 37/02 70/306 |
| 5,307,657 | A | 5/1994 | Klein et al. | |
| 6,708,534 | B1 | 3/2004 | Ruan | |
| 6,799,445 | B1 * | 10/2004 | Tsai | E05B 37/0031 70/284 |
| 6,955,069 | B2 * | 10/2005 | Segawa | E05B 1/0092 70/208 |
| 7,958,757 | B1 | 6/2011 | Lee | |
| 2008/0120999 | A1 | 5/2008 | Lee | |
| 2008/0314093 | A1 * | 12/2008 | Nave | E05B 37/025 70/21 |
| 2009/0145178 | A1 * | 6/2009 | Nave | E05B 37/02 70/21 |
| 2013/0055774 | A1 | 3/2013 | Yang | |
| 2014/0352370 | A1 * | 12/2014 | Huang | E05B 37/0034 70/21 |

OTHER PUBLICATIONS

European office action in related patent application No. 16195926.7, dated Mar. 15, 2017, seven pages.

* cited by examiner

ENGAGED

DIS-ENGAGED

LOCK

FIELD OF THE DISCLOSURE

The present invention relates to a lock, in particular to a lock including a primary locking device and an override mechanism.

BACKGROUND

It is known in the art of lock making to provide a lock including a primary locking device and a secondary locking device. U.S. Pat. No. 6,708,534, for example, describes a padlock including a combination lock and a cylinder lock. The padlock can be operated by either the cylinder lock or the combination lock. In the event that the key for the cylinder lock is lost, or the code for the combination lock is forgotten, the code may be reset or the cylinder may be replaced.

SUMMARY

Several methods of identifying and/or resetting codes for combination locks have been proposed in the prior art, and the present invention aims to provide an efficient and effective solution to the problem.

According to the present invention, there is provided a lock including a body which houses a combination lock, which is releasable by the selection of a set code, the code being selectable by the movement of one or more dials, the or each dial including a first part which is manipulable by a user, wherein the lock includes a code finding device to enable the set code to be identified, the code finding device including a code finding member associated with the or each dial, the or each code finding member being engageable with a second part of the respective dial, to identify a position of the dial which corresponds with a digit of the set code, wherein the second part of each dial is moveable relative to the first part of the respective dial and relative to the respective code finding member between a disengaged position and an engaged position, and wherein the or each code finding member is fixed substantially stationary relative to the body.

An advantage of fixing the code finding member(s) substantially stationary relative to the body of the lock is that the code finding member(s) are less prone to damage, e.g. breaking. This is due to the fact that the code finding member(s) do not move (e.g. translate) in to and out of engagement with the second part of the dial(s). It is believed that the configuration defined above is more robust than locks of the prior art where the code finding member(s) moves relative to the body of the lock.

According to a second aspect of the invention, there is provided a lock including a combination lock, which is releasable by the selection of a set code, the code being selectable by the movement of one or more dials, the or each dial including a first part which is manipulable by a user, wherein the lock includes a code finding device to enable the set code to be identified, the code finding device including a code finding member associated with the or each dial, the or each code finding member being engageable with a second part of the respective dial, to identify a position of the dial which corresponds with a digit of the set code, wherein the second part of each dial is moveable relative to the first part of the respective dial and relative to the respective code finding member between a disengaged position and an engaged position.

The second part of the or each dial may be moveable in a substantially axial direction relative to the first part of the respective dial and the respective code finding member.

The second part of the or each dial may include a groove, with which a part of the respective code finding member is engageable.

The second part of the or each dial may be a bush which is receivable within the first part of the respective dial.

The second part of the or each dial may be carried by a spindle and moveable in a substantially axial direction with the spindle.

The movement of the second part of the or each dial may be effected by operation of a cylinder lock.

The or each code finding member may be resilient or include a resilient portion.

According to a third aspect of the invention, there is provided a method of identifying a code of a combination lock, the combination lock being housed by a body and including one or more dials, a code finding device, and an override mechanism, the code finding device including a code finding member which is associated with the or each dial and which is fixed substantially stationary relative to the body, the method including operating the override mechanism to move a second part of the or each dial relative to a first part of the or each dial, so as to move the second part of the or each dial into an engaged position relative to the or each respective code finding member.

According to a fourth aspect of the invention, there is provided a method of identifying a code of a combination lock, the combination lock including one or more dials, including providing the lock with a code identifying device, the code identifying device including a code identifying member which is associated with the or each dial, the method including operating the code identifying device to move a second part of the or each dial relative to a first part of the or each dial, so as to move the or each second part of each dial into an engaged position relative to the or each respective code identifying member.

Operating the override mechanism may include turning a key in a cylinder lock.

The method may include setting a new code.

BRIEF DESCRIPTION OF THE DRAWINGS

The invention will now be described by way of example only, with reference to the accompanying drawings, of which.

DETAILED DESCRIPTION

Figure 2:
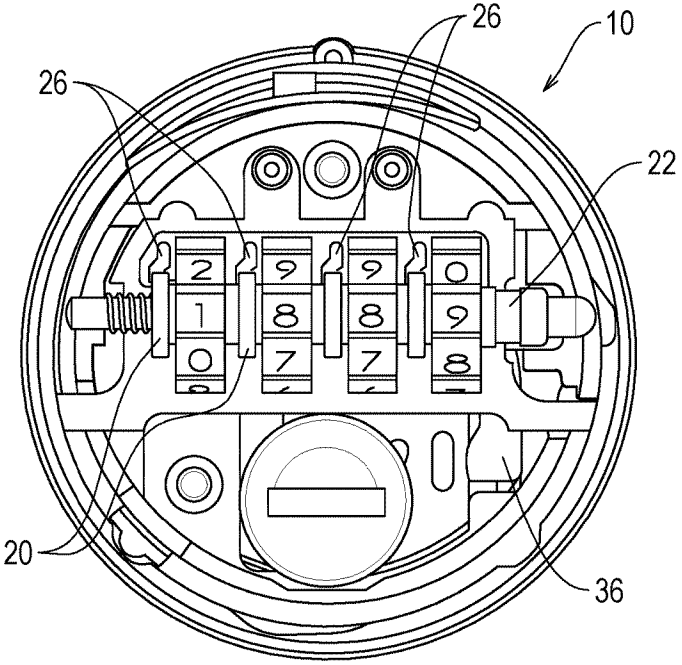
FIG. 2 is an illustrative plan view of the lock of FIG. 1 in an engaged configuration.

Referring to the figures, there is shown a lock 10, including a body 11 housing a primary locking device 12 and a secondary locking device 14. The primary locking device 12 is a combination lock having a plurality of dials 18, in the present example four dials 18, although it will be appreciated that any suitable number of dials may be provided. Each dial 18 is provided with indicia to enable the selection of a code. In the example shown, each dial 18 includes the numbers 0 to 9, to enable a four digit numerical code to be selected. The primary locking device 12 is settable, so that only one combination of numbers, in a specific order, i.e. the correct code, will enable the lock 10 to be opened. The lock 10 preferably includes a cover to cover the mechanisms of the lock 10, and which may also expose only one number per dial 18 to a user, so that it is clear which number of each dial 18 has been selected. Another means of indication, for example a marker, could additionally or alternatively be provided.

Each dial 18 is substantially cylindrical. Each dial 18 includes a first part which has an outer curved surface 18*a*, and a pair of substantially annular side faces 18*b*, 18*c*, which are substantially parallel to one another. Each dial 18 may be provided with grooves or grip portions on the outer surface 18*a*, to aid manual manipulation of each dial 18, for example to select the correct code. Each dial 18 includes a second part 20 which is receivable inside the respective first part of the dial 18.

In the present example, each second part 20 of each dial 18 is described as a bush 20. Each bush 20 is substantially annular. Each bush 20 includes a groove 21 which extends axially across a curved outer surface of the bush 20. Each dial 18 and each bush 20 is carried on a spindle 22 and is rotatable thereabout. The spindle 22 is moveable in a substantially axial direction between a disengaged position and an engaged position. In the present example, the spindle 22 is biased towards the disengaged position by a spring 23. Each bush 20 is carried by the spindle 22, and each bush is moveable in a substantially axial direction, relative to the respective first part of the dial 18.

The lock 10 also includes an override mechanism to enable the set code to be altered, for example in the event that the code has been forgotten or the lock 10 is to be used by a different user. In order to be able to reset the code, it may be necessary to identify the existing set code.

The lock 10 includes a code finding device 24, which includes a plurality of code finding members (or fingers) 26, each of which is engageable with the groove 21 in a respective bush 20. Each member 26 is resilient or includes a resilient portion. The code finding device 24 and the members 26 are fixed substantially stationary relative to the body 11 of the lock 10.

The override mechanism includes a cylinder lock 28. The cylinder lock 28 includes an opening 30 in which a key is receivable. The cylinder lock 28 may be a typical pin tumbler lock. The cylinder lock 28 is operable to control the operation of a code finder mechanism. A part of the cylinder lock, for example a barrel 32 is engageable with a drive mechanism 34 which includes a cam member 36 which is pivotable about an axis. The cam member 36 is engageable with the spindle 22, and operation of the cylinder lock 28 permits the substantially axial movement of the spindle 22, and the bushes 20 carried by the spindle 22, relative to the first parts of the dials 18 and the body 11.

In the present example, the secondary locking device 14 forms part of the override mechanism. However, it will be appreciated that the override mechanism could be separate from the secondary locking mechanism 14. It will also be appreciated that the secondary locking mechanism could be omitted from the lock, provided the code finding mechanism is still provided.

The lock 10 also includes a code change button 38. The code change button 38 is moveable between a first position, and a second position. The code change button may also be moveable to a third position. In the present example, in the first position the code change button 38 is flush with or within the perimeter of the body 11, such that the code change button 38 is inaccessible to a user. In the second position, the code change button 38 is depressed relative to the first position and relative to at least a part of the body 11. The code change button 38 is mechanically linked to the spindle 22, such that movement of the code change button 38 between the first position and the second position causes axial movement of the spindle 22 and the bushes 20.

In the present example, the body 11 includes a ring 13 which is rotatable relative to the remainder of the body 11 between a first position and a second position. When the lock 10 is in use, the ring 13 is positioned in the first 'locked' position such that the ring 13 inhibits the code change button 38 from being accessed by a user. When the lock 10 is in code finding/code reset mode, the ring 13 is rotatable to a position in which it allows access to the code change button 38. The ring 13 may include an opening through which the code change button 38 is able to protrude when the ring 13 is in the second 'access' position.

The code change button 38 may be biased towards a third position, such that when the ring 13 is rotated to the 'access' position, the code change button 38 'pops' up through the opening, to be easily accessible to a user.

Figure 1:
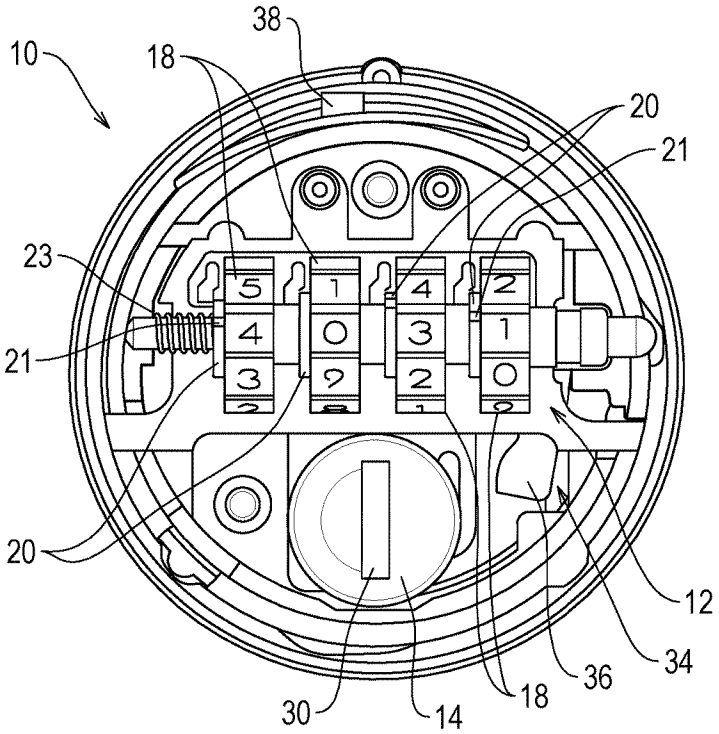
FIG. 1 is an illustrative plan view of a lock in accordance with the present invention in a disengaged configuration.
Figure 3:
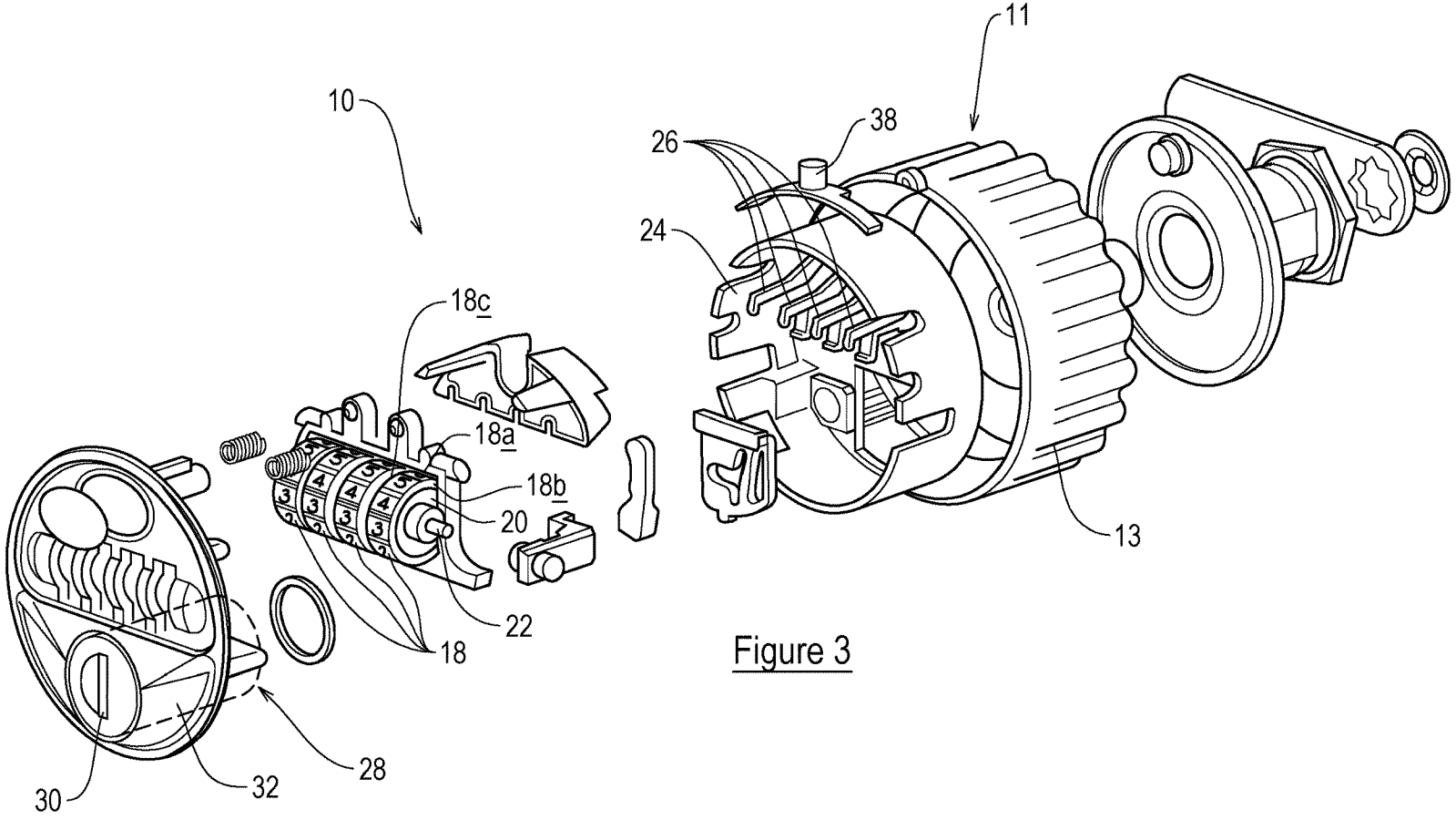
FIG. 3 is an exploded perspective view of the lock of FIGS. 1 and 2.

In use, a four digit code is set, such that selection of the correct digits, in the correct order, by rotation of the dials 18 will enable the primary locking device 12 to open. It will be appreciated that the number of digits which have to be correctly selected may be exactly the same as or differ from the number of dials provided. The number of dials 18 provided may also be varied. With the cylinder lock 28 in a 'disengaged' position (as shown in FIG. 1) the members 26 of the code finding device 24 are not engaged with the respective bushes 20, and each dial 18 is free to rotate, to attempt to select the correct digit to make up the set code.

When a key is inserted in the cylinder lock 28, and the cylinder lock 28 is turned to an 'engaged' position (as shown in FIG. 2), the cam member 36 pivots, and engages the spindle 22, moving the spindle 22 in a substantially axial direction. In the example shown, the spindle 22 is moved towards the left, and each bush 20 is moved out of axial alignment with its respective first part of the dial 18. Each member 26 of the code finding device 24 is engageable with a part of the outer surface of a respective bush 20. Each member 26 is deformed slightly by the movement of the respective bush 20. As each dial 18 is rotated, the respective bush 20 also rotates relative to the spindle 22, and the respective member 26 remains deformed by the presence of the respective bush 20, until the correct 'set' number is selected. At this time, the groove 21 on the outer surface of the respective bush 20 is aligned with the respective member 26 and the member 26 is received in the groove 21. This means that the deformation of the member 26 reduced. The location of the member 26 in the groove 21 inhibits or prevents the further rotation of the respective dial 18, and so the set number for that dial 18 is identified. The process is repeated for each dial 18, until all of the set numbers are known, and the code is identified.

Once the correct code has been identified, the ring 13 is rotatable through 90° which causes the code change button 38 to protrude from the body 11. It will be appreciated that another method of enabling access to the code change button 38 may be provided, and that where rotation of the ring 13 enables access to the code change button 38, rotation of the ring 13 through more or less than 90° may be appropriate.

When the code change button 38 is accessible, a user may depress the code change button 38 which moves the spindle 22 axially with the bushes 20 which disengages each bush 20 from its respective dial 18. This enables each dial to rotate independently, allowing the user to select a new code. Once the desired new code has been selected, the code change button 38 is released and the spindle assembly 22 is returned by the spring 23 to its rest position in which each bush 20 is engaged with its respective dial 18.

The ring 13 is then rotated back to the 'locked' position, making the code change button 38 inaccessible, as it is moved into its retracted position relative to the body 11.

The user may need to use a tool to depress the code change button 38, or it may be depressible manually. It will be appreciated that the relative positions or operation of the code change button 38 may be altered, for example, it may be desirable for the code change button to be able to 'toggle' rather than having to be held in the depressed position whilst the code is reset.

An advantage of the present invention is that the code finding mechanism is simplified compared to prior art solutions. There are fewer moving parts, since the code finding members 26 remain substantially stationary relative to the body 11 of the lock 10, and there is a lower risk of the more fragile parts of the mechanism, for example the code finding members 26, breaking, as they remain stationary.

As used herein, the expression "the or each code finding member is fixed substantially stationary relative to the body" is intended to mean the code finding member(s) do not translate when the override mechanism is actuated, since it is the second part of the dial(s) that moves. However, it is to be appreciated that the code finding member(s) may be resilient or have a resilient portions, and therefore the code finding member(s) or a portion thereof may flex when contacted by the second part.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. A lock including a body which houses a combination lock, which is releasable by the selection of a set code, the code being selectable by the movement of one or more dials, the or each dial including a first part which is manipulable by a user, wherein the lock includes a code finding device to enable the set code to be identified, the code finding device including a code finding member associated with the or each dial, the or each code finding member being engageable with a second part of the respective dial, to identify a position of the dial which corresponds with a digit of the set code, wherein the second part of each dial is moveable relative to the first part of the respective dial and relative to the respective code finding member between a disengaged position and an engaged position, and wherein the or each code finding member is resilient or has a resilient portion and is fixed stationary relative to the body.

2. A lock according to claim 1 wherein the second part of the or each dial is moveable in a substantially axial direction relative to the first part of the respective dial and the respective code finding member.

3. A lock according to claim 1 wherein the second part of the or each dial includes a groove, with which a part of the respective code finding member is engageable.

4. A lock according to claim 1 wherein the second part of the or each dial is a bush which is receivable within the first part of the respective dial.

5. A lock according to claim 1 wherein the second part of the or each dial is carried by a spindle and moveable in a substantially axial direction with the spindle.

6. A lock according to claim 1 wherein the movement of the second part of the or each dial is effected by operation of a cylinder lock.

7. A method of identifying a code of a combination lock, the combination lock being housed by a body and including one or more dials, a code finding device and an override mechanism, the code finding device including a code finding member which is associated with the or each dial and which is resilient or has a resilient portion and is fixed stationary relative to the body, the method including operating the override mechanism to move a second part of the or each dial relative to a first part of the or each dial, so as to move the second part of the or each dial into an engaged position relative to the or each respective code finding member.

8. A method of identifying a code of a combination lock according to claim 7 wherein operating the override mechanism includes turning a key in a cylinder lock.

9. A method according to claim 7 including the step of setting a new code.

* * * * *